US005565402A

United States Patent [19]

Tsuchida et al.

[11] Patent Number: 5,565,402

[45] Date of Patent: Oct. 15, 1996

[54] HEAT SENSITIVE RECORDING MATERIAL

[75] Inventors: Tetsuo Tsuchida; Naoko Kondo, both of Takarazuka; Nobuhisa Dano, Chiba, all of Japan

[73] Assignee: New Oji Paper Co., Ltd., Tokyo, Japan

[21] Appl. No.: 501,465

[22] Filed: Jul. 12, 1995

[30] Foreign Application Priority Data

Jul. 26, 1994 [JP] Japan ..... 6-173045

[51] Int. Cl.$^6$ ..... B41M 5/30

[52] U.S. Cl. ..... 503/217; 503/216; 503/218; 503/221

[58] Field of Search ..... 503/216, 217, 503/218, 221

[56] References Cited

U.S. PATENT DOCUMENTS 4,612,557 8/1986 Hama et al. ..... 346/216

5,364,732 11/1994 Mouri et al. ..... 430/201

5,401,699 3/1995 Ohashi et al. ..... 503/217

FOREIGN PATENT DOCUMENTS

0478263B1 9/1991 European Pat. Off. .

*Primary Examiner*—B. Hamilton Hess

*Attorney, Agent, or Firm*—Nikaido, Marmelstein, Murray & Oram LLP

[57] ABSTRACT

The present invention provides a heat sensitive recording material comprising a substrate and a recording layer thereon incorporating a colorless or light-colored basic dye and a color acceptor, the recording material being characterized in that, the basic dye comprises at least one black-forming fluoran derivative and at least one phenothiazine derivative such as 3,7-bis(dimethylaminophenyl)-10-benzoylphenothiazine in an amount of 5 to 100 wt. % based on the fluoran derivative, and the color acceptor comprises a diphenyl sulfone derivative such as 3,3'-diallyl-4,4'-dihydroxydiphenyl sulfone.

5 Claims, No Drawings

HEAT SENSITIVE RECORDING MATERIAL

The present invention relates to heat sensitive recording materials utilizing a color forming reaction between a colorless or light-colored basic dye and a color acceptor, and more particularly to heat sensitive recording materials which are excellent in optical character readability in the wavelength region of 650 to 700 nm.

Heat sensitive recording materials are well known which utilize a color forming reaction between a colorless or light-colored basic dye and an organic or inorganic color acceptor to obtain recorded images by thermally bringing the two chromogenic substances into contact with each other. Such heat sensitive recording materials are relatively inexpensive, while recording devices therefor are compact and relatively easy to maintain, so that these materials serve as recording media for facsimile systems, various computers, etc. and are also used in a wide variety of fields.

To meet diversified needs in recent years, various properties are required of heat sensitive recording materials. As one type of desired materials, it is required to provide heat sensitive recording materials for optical character reader (OCR) or optical mark reader (OMR) which produce a black color and which are adapted for reading in the wavelength region of 650 to 700 nm. Such recording materials are prepared, for example, by merely using an increased amount of fluoran dye conventionally used for producing a black color, or by using a dye exhibiting strong absorption in the range of 650 to 700 nm when producing color, e.g., 3,3-bis(4-diethylamino-2-ethoxyphenyl)-4-azaphthalide, 3-di-n-butylamino- 6,8,8-trimethyl-8,9-dihydro-(3,2,e)pyridofluoran or the like, in combination with a black-forming fluoran dye. However, it is strongly desired to improve the material prepared by the method because although having the optical character readability immediately after color formation, the material loses this property when subjected to a high temperature and a high humidity or exposed to light, or becomes colored in the blank area (background fogging) during a long period of preservation.

An object of the present invention is to overcome the above problem and to provide a heat sensitive recording material which is outstanding in optical character readability in the wavelength region of 650 to 700 nm.

The above and other objects of the invention will become apparent from the following description.

The present invention provides a heat sensitive recording material comprising a substrate and a recording layer thereon incorporating a colorless or light-colored basic dye and a color acceptor, the recording material being characterized in that, the basic dye comprises at least one black-forming fluoran derivative and at least one phenothiazine derivative represented by the following formula (1) in an amount of 5to 100 wt. % based on the fluoran derivative, and the color acceptor comprises a diphenyl sulfone derivative represented by the following formula (2)

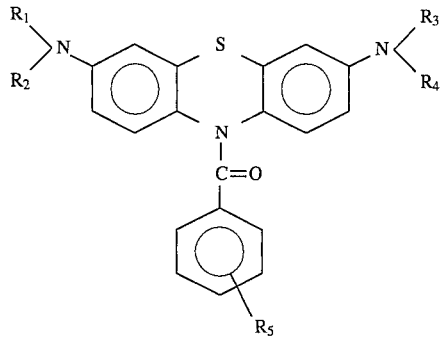

(1)

wherein $R_1$ to $R_4$ are each $C_1$~$C_4$ alkyl, and $R_5$ is a hydrogen atom, halogen atom, $C_1$~$C_4$ alkyl or $C_1$~$C_4$ alkoxyl

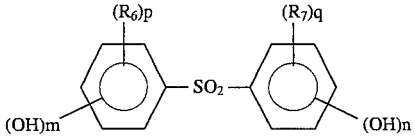

(2)

wherein $R_6$ and $R_7$ are each $C_1$~$C_4$ alkyl, $C_2$~$C_4$ alkenyl, $C_1$~$C_4$ alkoxyl, benzyloxy or a halogen atom, m is an integer of 0 to 2, n is an integer of 1 to 3, and p and q are each an integer of 0 to 2.

More specifically, the present invention provides a black-forming heat sensitive recording material which remains unimpaired in optical character readability in the wavelength region of 650 to 700 nm even when exposed to a high temperature, high humidity or light for a long period of time and which is diminished in background fogging, by using the combination of a black-forming fluoran derivative and a specified phenothiazine derivative in a specified ratio as a colorless or light-colored basic dye, and further using a specified diphenyl sulfone derivative as a color acceptor.

According to the present invention, a heat sensitive recording material adapted to produce a black color is obtained which is free of impairment in optical character readability in the wavelength region of 650 to 700 nm even when exposed to a high temperature, high humidity or light for a long period of time and which is less susceptible to background fogging, by using a black-forming fluoran derivative and a specified phenothiazine derivative in combination therewith in an amount of 5 to 100 wt. %, preferably 10 to 50 wt. %, based on the fluoran derivative, and further using a specified diphenyl sulfone derivative as a color acceptor.

An increase in the amount of the basic dye in the recording layer naturally results in improved optical character readability, whereas it is desirable to adjust the amount of basic dye in the range of 0.2 to 1.0 $g/m^2$ in view of the recording sensitivity, yellowing of the recording material due to exposure to light before use and economy.

If less than 5 wt. % of the phenothiazine derivative is present in the recording layer, the material fails to retain the optical character readability especially after exposure to light for a long period of time. If more than 100 wt. % of this derivative is present, the material exhibits an impaired optical character readability immediately after color formation or develops background fog due to the influence of temperature, humidity or light.

As the black-forming fluoran derivatives usable in the invention, preferable are the compounds represented by the following formula (3)

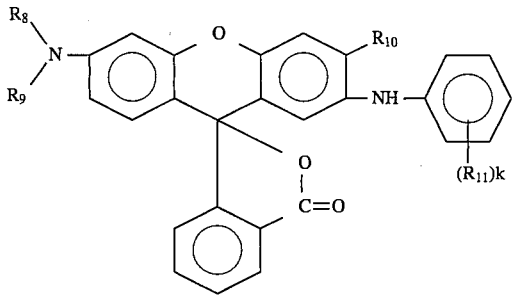

(3)

wherein $R_8$ and $R_9$ are each $C_1$~$C_6$ alkyl, ethoxypropyl or p-tolyl, $R_{10}$ is a hydrogen atom or methyl, $R_{11}$ is methyl, chlorine atom or trifluoromethyl, k is an integer of 0 to 2.

Examples of usuful black-forming fluoran derivatives are
3-diethylamino-6-methyl-7-anilinofluoran,
3-diethylamino-6-methyl-7-(m-toluidino)fluoran,
3-diethylamino-6-methyl-7-(2,4-xylidino)fluoran,
3-diethylamino-6-methyl-7-(2,6-xylidino)fluoran,
3-dimethylamino-6-methyl-7-anilinofluoran,
3-di-n-propylamino-6-methyl-7-anilinofluoran,
3-(N-methyl-N-cyclohexylamino)-6-methyl-7-anilinofluoran,
3-(N-ethyl-N-cyclohexylamino)-6-methyl-7-anilinofluoran,
3-(N-ethyl-p-toluidino)-6-methyl-7-anilinofluoran,
3-(N-ethyl-p-toluidino)-6-methyl-7-(p-toluidino)fluoran,
3-di-n-butylamino-6-methyl-7-anilinofluoran,
3-di-n-pentylamino-6-methyl-7-anilinofluoran,
3-(N-methyl-N-n-propylamino)-6-methyl-7-anilinofluoran,
3-(N-ethyl-N-isopentylamino)-6-methyl-7-anilinofluoran,
3-(N-ethyl-N-n-hexylamino)-6-methyl-7-anilinofluoran,
3-(N-ethyl-N-isobutylamino)-6-methyl-7-anilinofluoran,
3-diethylamino-7-(o-chloroanilino)fluoran,
3-di-n-butylamino-7-(o-chloroanilino)fluoran,
3-(N-ethyl-N-n-hexylamino)-7-(o-chloroanilino)fluoran,
3-(N-ethyl-N-isopentylamino)-7-(o-chloroanilino)fluoran,
3-di-n-butylamino-7-(o-fluoroanilino)fluoran,
3-di-n-butylamino-6-methyl-7-(p-chloroanilino)fluoran,
3-diethylamino-7-(m-trifluoromethylanilino)fluoran,
3-di-n-butylamino-7-(p-trifluoromethylanilino)fluoran,
3-(N-ethyl-N-cylcopentylamino)-6-methyl-7-anilinofluoran,
3-(N-ethyl-N-ethoxypropyl)amino-6-methyl-7-anilinofluoran,
3-(N-methyl-N-ethoxypropyl)amino-6-methyl-7-anilinofluoran,
di-n-butylamino-6-methyl-7-(m-toluidino)fluoran and
di-n-butylamino-6-methyl-7-(2,6-xylidino)fluoran.

Among the black-forming fluoran derivatives, especially preferable is 3-di-n-butylamino-6-methyl-7-anilinofluoran which is excellent in color forming ability and less susceptible to background fogging.

The phenothiazine derivative of the formula (1) above and used in combination with the above fluoran derivative in the invention is a dye which forms blue color when used singly. The followings are examples thereof.
3,7-Bis(dimethylamino)-10-benzoylphenothiazine,
3,7-bis(diethylamino)-10-benzoylphenothiazine,
3,7-bis(di-n-butylamino)-10O-benzoylphenothiazine,
3,7-bis(dimethylamino)-10-(4-methylbenzoyl)phenothiazine,
3,7-bis(diethylamino)-10-(4-methylbenzoyl)phenothiazine,
3,7-bis(di-n-butylamino)-10-(4-methylbenzoyl)phenothiazine,
3,7-bis(dimethylamino)-10-(4-methoxybenzoyl)phenothiazine,
3,7-bis(dimethylamino)-10-(4-ethoxybenzoyl)phenothiazine,
3,7-bis(dimethylamino)-10-(4-chlorobenzoyl)phenothiazine,
3,7-bis(dimethylamino)-10-(2-methylbenzoyl)phenothiazine,
3,7-bis(dimethylamino)-10-(2-methoxybenzoyl)phenothiazine,
3,7-bis(dimethylamino)-10-(3-methoxybenzoyl)phenothiazine,
3,7-bis(dimethylamino)-10-(2-chlorobenzoyl)phenothiazine,
3,7-bis(di-n-butylamino)-10-(4-chlorobenzoyl)phenothiazine and
3-diethylamino-7-dimethylamino-10-benzoylphenothiazine.

Among the above, particularly preferable are the compounds of the formula (4) below which are easy in availability of raw materials, inexpensive and excellent in record image preservability, especially in light resistance

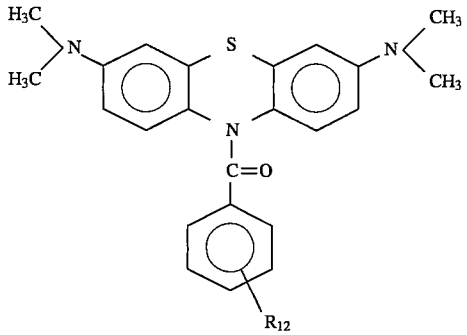

(4)

wherein $R_{12}$ is a hydrogen atom, halogen atom, $C_1$~$C_4$ alkyl or $C_1$~$C_4$ alkoxyl. Of course, the phenothiazine derivative is not limited to the above and can be used in at least two of them as required.

Although, in the heat sensitive recording material of the invention, the above specific fluoran derivative and specific phenothiazine derivative are used in combination at a specific ratio, it is possible to achieve excellent effects in the record image preservability and fogging in the background area by selectively combining as a color acceptor the above diphenyl sulfone derivative of the formula (2). Examples of the diphenyl sulfone derivatives are set forth below.
4,4'-Dihydroxydiphenyl sulfone,
2,4'-dihydroxydiphenyl sulfone,
3,3'-diallyl-4,4'-dihydroxydiphenyl sulfone,
3,3',5,5'-tetrabromo-4,4'-dihydroxydiphenyl sulfone,
3,3',5,5'-tetrachloro-4,4'-dihydroxydiphenyl sulfone,
4-hydroxydiphenyl sulfone,
4-hydroxy-4'-methyldiphenyl sulfone,
4-hydroxy-3',4'-tetramethylenediphenyl sulfone,
4-hydroxy-4'-methoxydiphenyl sulfone,
4-hydroxy-4'-ethoxydiphenyl sulfone,
4-hydroxy-4'-isopropoxydiphenyl sulfone,
4-hydroxy-4'-n-propoxydiphenyl sulfone,
4-hydroxy-4'-n-butoxydiphenyl sulfone,
4-hydroxy-4'-benzyloxydiphenyl sulfone,
3,4-dihydroxydiphenyl sulfone,
3,4-dihydroxy-4'-methyldiphenyl sulfone,
3,4,4'-trihydroxydiphenyl sulfone,
3,4,3',4'-tetrahydroxydiphenyl sulfone and
2,3,4-trihydroxydiphenyl sulfone.

Of course, the derivative is not limited to the above and can be used in at least two of them as required.

Among these diphenyl sulfone derivatives, more preferable are 3,3'-diallyl-4,4'-dihydroxydiphenyl sulfone, 2,4'- dihydroxydiphenyl sulfone and 4-hydroxy-4'-isopropoxydiphenyl sulfone which can afford a heat sensitive recording material having diminished background fogging, excellent recording sensitivity and optical character readability under a high temperature and a high humidity.

Although, in the present invention, the above specific diphenylsulfone derivative is used selectively as a color acceptor, other known color acceptor can be used conjointly in an amount which does not cause adverse effect.

The proportions of the basic dye and the color acceptor are not particularly limited but usually 100 to 1000 parts by weight, preferably 200 to 500 parts by weight, of the color acceptor is used per 100 parts by weight of the dye.

In the present heat sensitive recording material, it is possible to add a recording sensitivity improving agent to a recording layer. Examples of useful agents are caproic acid amide, captic acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy- 2-(4-methoxyphenoxy)ethane, 1-(2-methylphenoxy)-2-(4-methoxyphenoxy)ethane, dibenzyl terephthalate, dibenzyl oxalate, di(4-methylbenzyl)oxalate, benzyl p-benzyloxybenzoate, p-benzylbiphenyl, 1,5-bis(p-methoxyphenoxy)-3-oxapentane, 1,4-bis(2-vinyloxyethoxy)benzene, p-biphenyl p-tolyl ether, benzyl p-methylthiophenyl ether, 2-(2'-hydroxy- 5'-methylphenyl)benzotriazole and 2-hydroxy-4-benzyloxybenzophenone.

It is desired that the amount of the recording sensitivity improving agent to be used be adjusted generally within the range of usually 50 to 1000 parts by weight, preferably 100 to 500 parts by weight per 100 parts by weight of the basic dye although not limited specifically. In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc.

It is also possible to incorporate various known preservability improving agents to the recording layer in order to further improve the preservability of recorded images. Examples of useful preservability improving agents are 1,1,3-tris(2-methyl-4-hydroxy-5-cyclohexylphenyl)butane, 1,1,3-tris(2-methyl-4-hydroxy-5-tert.-butylphenyl)butane, 4,4'-thiobis(3-methyl-5-tert-butylphenol), 1,3,5-trimethyl-2,4,6-tris(4,5-di-tert-butyl-4-hydroxybenzyl)benzene, 2,2'-dihydroxy- 4,4'-dimethoxybenzophenone, p-octylphenylsalicylate, 2-(2'-hydroxy-5'-methylphenyl)benzotriazole, ethyl 2-cyano- 3,3'-diphenylacrylate, tetrakis(1,2,2,6,6-pentamethyl-4-piperidyl)- 1,2,3,4-butanetetracarboxylate, 4-benzyloxy-4'-( 2,3-glycidyloxy)diphenyl sulfone, sodium or magnesium salt of 2,2'-methylenebis(4,6-di-tert-butylphenyl)phosphoric acid, etc.

For preparing a coating composition comprising the foregoing components, the dye and the color acceptor are dispersed, together or individually, into water serving as a dispersing medium, using stirring and pulverizing means such as a ball mill, attritor or sand mill. Of course, the fluoran derivative and the phenothiazine derivative of the formula (1) are dispersed together or individually.

In the present invention, a binder can be conjointly used in an amount of 10 to 40% by weight, preferably 15 to 35% by weight based on the total solids of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc.

Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., ultraviolet absorbers such as triazole compounds, defoaming agents, fluorescent dyes, coloring dyes, antioxidants, etc. Further, to the composition may be added, in order to prevent sticking upon contact of the heat sensitive recording material with a recording device or a thermal head, a dispersion or emulsion of stearic acid, polyethylene, carnauba wax, paraffin wax, zinc stearate, calcium stearate, ester wax or the like.

Examples of useful substrates are paper (including neutral paper), plastic film, synthetic paper, sheets prepared by affixing a plastic film or synthetic paper to coated paper, wood-free paper or the like with an adhesive, and sheets obtained by laminating a plastic to paper.

Examples of useful plastic films are those of polyethylene, polyester, polypropylene, polyvinyl chloride, polystyrene and nylon. Examples of useful synthetic papers are those prepared by film methods or the fiber method. The film methods include the internal paper making method wherein a synthetic resin, filler and additives are melted and kneaded, and the resulting mixture is extruded into a film, the surface coating method wherein a pigment coating layer is formed, and the surface treating method. Synthetic papers obtained by the fiber method include synthetic pulp paper and spun bonded paper.

In the present heat sensitive recording material, the method of coating i the recording layer is not particularly limited. For example, the coating composition is applied to a substrate by a bar coater, air knife coater, rod blade coater, pure blade coater, short dwell coater or like suitable means which are well known fin the art and dried. In case of using a plastic film as the substrate, it is possible to enhance coating efficiency by Subjecting the surface to corona discharge treatment, electron rays irradiation or the like. The amount of coating Composition to be applied, which is not limited particularly, is usually 2 to 10 g/m$^2$, preferably 3 to 7 g/m$^2$, based on dry weight.

Further, it is possible to enhance resistance to chemicals such as a plasticizer or oil by providing on the heat sensitive recording layer a protective layer which is constituted by an adhesive, lubricant, pigment or the like. Examples of adhesives usable in the protective layer are polyvinyl alcohol having various saponification degrees, acetoacetylated polyvinyl alcohol, carboxylated polyvinyl alcohol, silicone-modified polyvinyl alcohol, acrylic resin, polyurethane resin, etc. The adhesive can be used in an amount of 10 to 95% by weight, preferably 30 to 90% by weight based on the total solids of the protective layer. The protective layer is coated in an amount of 0.5 to 10 g/m$^2$, preferably 1 to 7 g/m$^2$, based on dry weight.

Various other known techniques in the field of heat sensitive recording materials can be applied. For example, it is possible to form on the protective layer a layer comprising a water-soluble, water-dispersible, electron ray-curable or ultraviolet ray-curable resin in order to provide excellent gloss, to form a protective layer on the rear surface of the substrate, to form an undercoat layer on the surface of the substrate.

The invention will be described below in more detail with reference to examples without limiting the scope thereof. In the followings, parts and percentages are all by weight, unless otherwise specified.

EXAMPLE 1

Composition (A)

3-Di-n-butylamino-6-methyl-7-anilinofluoran (10 parts), 3 parts of 5% aqueous solution of methyl cellulose and 27 parts of water were pulverized by a sand mill to prepare Composition (A) having an average particle size of 0.8 μm.

Composition (B)

3,7-Bis(dimethylaminophenyl)-10-benzoylphenothiazine (10 parts), 3 parts of 5% aqueous solution of methyl cellulose and 27 parts of water were pulverized by a sand mill to prepare Composition (B) having an average particle size of 0.8 μm.

Composition (C)

3,3'-Diallyl-4,4'-dihydroxydiphenyl sulfone (20 parts), 5 parts of 5% aqueous solution of methyl cellulose and 55 parts of water were pulverized by a sand mill to prepare Composition (C) having an average particle size of 1.2 μm.

Composition (D)

1,2-Bis(3-methylphenoxy)ethane (25 parts), 7 parts of 5% aqueous solution of methyl cellulose and 48 parts of water were pulverized by a sand mill to prepare Composition (D) having an average particle size of 1.2 μm.

Formation of a recording layer

A coating composition was prepared by mixing with stirring 32 parts of Composition (A), 8 parts of Composition (B), 80 parts of Composition (C), 80 parts of Composition (D), 10 parts of precipitated calcium carbonate, 20 parts of finely divided anhydrous silica (oil absorption: 180 ml/100 g), 100 parts of 15% aqueous solution of polyvinyl alcohol, 15 parts of 30% aqueous dispersion of zinc stearate. To a wood-free paper weighing 50 g/m$^2$ was applied the above coating composition in an amount of 4 g/m$^2$ by dry weight, then dried and treated by a supercalender to obtain a heat sensitive recording paper.

EXAMPLES 2 TO 7

Heat sensitive recording papers were prepared in the same manner as in Example 1 except that the following compounds were used in place of 3,7-bis(dimethylaminophenyl)- 10-benzoylphenothiazine in the preparation of Composition (B) in Example 1.

Example 2: 3,7-bis(dimethylaminophenyl)-10-(4-methylbenzoyl)phenothiazine

Example 3: 3,7-bis(dimethylaminophenyl)-10-(4-methoxybenzoyl)phenothiazine

Example 4: 3,7-bis(dimethylaminophenyl)-10-(2-methoxybenzoyl)phenothiazine

Example 5: 3,7-bis(dimethylaminophenyl)-10-(4-isopropoxybenzoyl)phenothiazine

Example 6: 3,7-bis(diethylaminophenyl)-10-benzoylphenothiazine

Example 7: 3,7-bis(di-n-butylaminophenyl)-10-(4-chlorobenzoyl)phenothiazine

EXAMPLES 8 AND 9

Heat sensitive recording papers were prepared in the same manner as in Example 1 except that the following compounds were used in place of 3,3'-diallyl-4,4'-dihydroxydiphenyl sulfone in the preparation of Composition (C) in Example 1.

Example 8: 2,4'-dihydroxydiphenyl sulfone

Example 9: 4-hydroxy-4'-isopropoxydiphenyl sulfone

EXAMPLE 10

A heat sensitive recording paper was prepared in the same manner as in Example 1 except that 3-diethylamino-7-(m-trifluoromethylanilino)fluoran was used in place of 3-di-n-butylamino- 6-methyl-7-anilinofluoran in the preparation of Composition (A) in Example 1.

EXAMPLES 11 TO 14

Heat sensitive recording papers were prepared in the same manner as in Example 1 except that the following proportions of Composition (A) and Composition (B) were used in place of 32 parts of Composition (A) and 8 parts of Composition (B) in the formation of the recording layer.

Example 11: Composition (A) 24 parts, Composition (B) 16 parts

Example 12: Composition (A) 28 parts, Composition (B) 12 parts

Example 13: Composition (A) 36 parts, Composition (B) 4 parts

Example 14: Composition (A) 38 parts, Composition (B) 2 parts

Comparison Examples 1 to 3

Heat sensitive recording papers were prepared in the same manner as in Example 1 except that the following proportions of Composition (A) and Composition (B) were used in place of 32 parts of Composition (A) and 8 parts of Composition (B) in the formation of the recording layer.

Com. Ex. 1: Composition (A) 40 parts, Composition (B) 0 part

Com. Ex. 2: Composition (A) 39 parts, Composition (B) 1 part

Com. Ex. 3: Composition (A) 16 parts, Composition (B) 24 parts

Comparison Examples 4 and 5

Heat sensitive recording papers were prepared in the same manner as in Example 1 except that the following compounds were used in place of 3,7-bis(dimethylaminophenyl)- 10-benzoylphenothiazine in the preparation of Composition (B) in Example 1.

Com. Ex. 4: 3,3-bis(4-diethylamino-2-ethoxyphenyl)-4-azaphthalide

Com. Ex. 5: 3-di-n-butylamino-6,8,8-trimethyl-8,9-dihydro-( 3,2,e)pyridofluoran

Comparison Example 6

A heat sensitive recording paper was prepared in the same manner as in Example 1 except that 4,4'-isopropylidenediphenol was used in place of 3,3'-diallyl-4,4'-dihydroxydiphenyl sulfone in the preparation of Composition (C) in Example 1.

The heat sensitive recording materials thus obtained were evaluated by the following methods. The results were given in Table 1.

[PCS value]

The PCS value serves as an index indicating the degree of OCR property. The PCS value represents the relative density difference between a recorded area and an unrecorded area, and is given by the following equation $$PCS=(Rw-Rp)/Rw$$

wherein Rw is the reflectance of the unrecorded area, and Rp is the reflectance of the recorded area. Accordingly, the higher the PCS value, the more discernible is the recorded area from the unrecorded area and the higher is the readability. Generally, the PCS value should be at least 0.7, preferably at least 0.8.

[Measurement of PCS values at 670 nm]

Images were recorded on the heat sensitive recording material by a heat sensitive recording tester (Model TH-PMD, product of Ohkura Denki Co., Ltd., applied voltage 16 V, pulse cycle 0.51 ms, applied pulse width 0.3 ms). The reflectance of the recorded area and the unrecorded area was measured at a wavelength of 670 nm by a spectrophotometer (Model U-3300, product of Hitachi, Ltd.), and the PCS value was calculated from the measurements. The recorded images obtained were all black.

[Background fog]

The unrecorded area was checked for fog by a Macbeth densitometer (Model RD-914 with a visual filter, product of Macbeth Corp.).

[Resistance to moisture and heat]

The recording material used for recording was allowed to stand at 50° C. and 90% RH for 72 hours and thereafter checked for PCS value and background fog.

[Light fastness]

The recording material used for recording was exposed directly to sunlight for 24 hours and thereafter checked for PCS value and background fog.

TABLE 1

| | PCS value | | | background fog | | |
|---|---|---|---|---|---|---|
| | A | B | C | A | B | C |
| Ex. 1 | 0.89 | 0.85 | 0.93 | 0.06 | 0.07 | 0.08 |
| 2 | 0.87 | 0.84 | 0.91 | 0.06 | 0.08 | 0.09 |
| 3 | 0.85 | 0.82 | 0.88 | 0.06 | 0.06 | 0.09 |
| 4 | 0.83 | 0.75 | 0.79 | 0.06 | 0.07 | 0.09 |
| 5 | 0.82 | 0.76 | 0.78 | 0.06 | 0.06 | 0.08 |
| 6 | 0.82 | 0.75 | 0.78 | 0.06 | 0.06 | 0.09 |
| 7 | 0.83 | 0.72 | 0.73 | 0.06 | 0.08 | 0.09 |
| 8 | 0.87 | 0.83 | 0.91 | 0.06 | 0.06 | 0.08 |
| 9 | 0.89 | 0.84 | 0.90 | 0.06 | 0.08 | 0.09 |
| 10 | 0.85 | 0.81 | 0.87 | 0.06 | 0.07 | 0.08 |
| 11 | 0.82 | 0.78 | 0.93 | 0.06 | 0.09 | 0.10 |
| 12 | 0.87 | 0.83 | 0.92 | 0.06 | 0.07 | 0.08 |
| 13 | 0.85 | 0.81 | 0.85 | 0.06 | 0.07 | 0.08 |
| 14 | 0.83 | 0.73 | 0.72 | 0.06 | 0.07 | 0.08 |
| Com. Ex. 1 | 0.75 | 0.63 | 0.23 | 0.06 | 0.07 | 0.08 |
| 2 | 0.78 | 0.67 | 0.45 | 0.06 | 0.07 | 0.09 |
| 3 | 0.68 | 0.58 | 0.95 | 0.07 | 0.12 | 0.15 |
| 4 | 0.89 | 0.84 | 0.53 | 0.08 | 0.15 | 0.26 |
| 5 | 0.87 | 0.64 | 0.38 | 0.10 | 0.18 | 0.32 |
| 6 | 0.87 | 0.58 | 0.65 | 0.09 | 0.15 | 0.23 |

A: before test

B: after resistance test to moisture and heat

C: after exposure to light

As apparent from the results in Table 1, the present heat sensitive recording material is sufficiently high in PCS value at the wavelength of 670 nm even after exposed to a high temperature, high humidity or light for a long period of time and is less susceptible to background fogging.

What is claimed is:

1. A heat sensitive recording material comprising a substrate and a recording layer thereon incorporating a colorless or light-colored basic dye and a color acceptor, the recording material being characterized in that, the basic dye comprises at least one black-forming fluoran derivative and at least one phenothiazine derivative represented by the following formula (1) in an amount of 5 to 100 wt. % based on the fluoran derivative, and the color acceptor comprises a diphenyl sulfone derivative represented by the following formula (2)

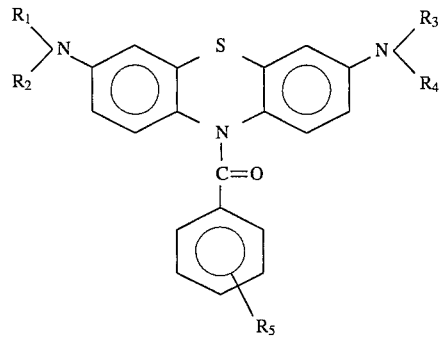

(1)

wherein $R_1$ to $R_4$ are each $C_1$~$C_4$ alkyl, and $R_5$ is a hydrogen atom, halogen atom, $C_1$~$C_4$ alkyl or $C_1$~$C_4$ alkoxyl

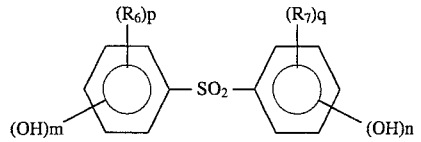

(2)

wherein $R_6$ and $R_7$ are each $C_1$~$C_4$ alkyl, $C_2$~$C_4$ alkenyl, $C_1$~$C_4$ alkoxyl, benzyloxy or a halogen atom, m is an integer of 0 to 2, n is an integer of 1 to 3, and p and q are each an integer of 0 to 2.

2. A heat sensitive recording material as defined in claim 1 wherein the phenothiazine derivative is represented by the formula (4) below

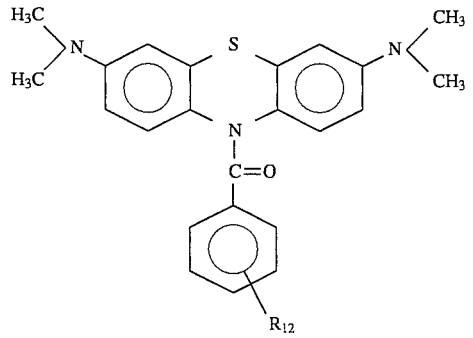

(4)

wherein $R_{12}$ is a hydrogen atom, halogen atom, $C_1$~$C_4$ alkyl or $C_1$~$C_4$ alkoxyl.

3. A heat sensitive recording material as defined in claim 1 wherein the diphenyl sulfone derivative is 3,3'-diallyl-4,4'-dihydroxydiphenyl sulfone, 2,4'-dihydroxydiphenyl sulfone or 4-hydroxy-4'-isopropoxydiphenyl sulfone.

4. A heat sensitive recording material as defined in claim 1 wherein the black-forming fluoran derivative is represented by the formula (3) below

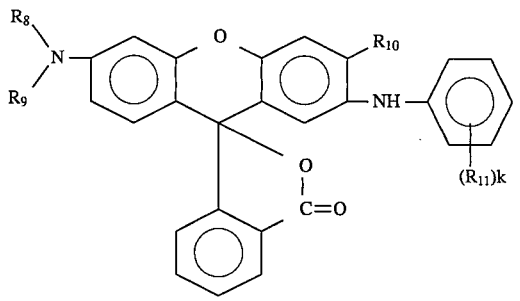
(3)
wherein $R_8$ and $R_9$ are each $C_1$~$C_6$ alkyl, ethoxypropyl or p-tolyl, $R_{10}$ is a hydrogen atom or methyl, $R_{11}$ is methyl, chlorine atom or trifluoromethyl, k is an integer of 0 to 2.
5. A heat sensitive recording material as defined in claim 1 wherein the phenothiazine derivative is used in an amount of 10 to 50 wt. % based on the fluoran derivative.
* * * * *